United States Patent [19]

Kmak et al.

[11] 4,222,852

[45] Sep. 16, 1980

[54] METHOD FOR REMOVING CORONENE FROM HEAT EXCHANGERS

[75] Inventors: Walter S. Kmak, Scotch Plains; Akira Yatabe, Lake Hiawatha, both of N.J.

[73] Assignee: Exxon Research & Engineering Co., Florham Park, N.J.

[21] Appl. No.: 9,229

[22] Filed: Feb. 2, 1979

[51] Int. Cl.[2] ..... C10G 9/16; C10G 39/00; C07C 15/12

[52] U.S. Cl. ..... 208/48 R; 203/4; 203/87; 208/95; 208/133; 585/320; 585/950

[58] Field of Search ..... 208/48 R, 95, 133–134; 585/950

[56] References Cited

U.S. PATENT DOCUMENTS

| | | | |
|---|---|---|---|
| 1,672,801 | 6/1928 | Buerger | 208/48 R |
| 2,953,514 | 9/1960 | Wilkins | 208/95 |
| 3,322,842 | 5/1967 | Czajkowski et al. | 585/488 |
| 3,619,407 | 11/1971 | Hendricks et al. | 208/48 R |
| 3,725,247 | 4/1973 | Johnson et al. | 208/111 |
| 3,793,182 | 2/1974 | Ward | 208/111 |

*Primary Examiner*—Delbert E. Gantz
*Assistant Examiner*—G. E. Schmitkons
*Attorney, Agent, or Firm*—Marthe L. Gibbons

[57] ABSTRACT

Coronene deposits are removed from a heat exchange zone of the reforming process by recycling a portion of the normally liquid reformate to the heat exchange zone to dissolve the coronene deposits.

4 Claims, 2 Drawing Figures

METHOD FOR REMOVING CORONENE FROM HEAT EXCHANGERS

BACKGROUND OF THE INVENTION

1. Field of the Invention

The present invention relates to a method of removing coronene deposits from a heat exchange zone of the reforming process.

2. Description of the Prior Art

Reforming is a well-known process in which a hydrocarbonaceous feedstock such as naphtha is contacted at elevated temperature and pressure in the presence of added hydrogen with a solid catalyst to increase the aromaticity of the feedstock. See, for example, Hydrocarbon Processing, Sept. 1976, pp. 171 to 178. The effluent of the reforming zone comprises undesired polycyclic aromatic compounds including coronene in amounts which vary depending on the operating conditions. Coronene ($C_{24}H_{12}$) is a polycyclic aromatic compound having a structure which contains seven benzene rings in a circular pattern with no side chains. Its molecular weight is 300 and its melting point is 440° C. Because of its high melting point, when coronene is present in relatively high concentrations, coronene readily deposits as a solid upstream of the effluent dew point in the heat exchanger used to cool the effluent.

U.S. Pat. No. 3,322,842 discloses recycling a portion of the gasoline reformate to the total reaction effluent prior to separating the reaction product into gaseous phase and liquid phase to minimize catalyst deactivation caused by polycyclic aromatic compounds such as coronene.

U.S. Pat. No. 1,672,801 discloses the use of a solvent, such as naphtha, to dissolve asphalt in clogged draw-off pipes or separation zones of hydrocarbon conversion processes.

U.S. Pat. No. 3,725,247 discloses that polynuclear aromatics which have a deleterious effect on the catalyst are formed during hydrocracking. It teaches treatment of the catalyst to avoid formation of polyaromatic compounds.

U.S. Pat. No. 2,953,514 relates to a method of reducing heat exchanger fouling. It discloses injecting a portion of the liquid reformate boiling at least above 450° F. in the stream of the reactor effluent at a point upstream of the heat exchanger.

It has now been found that by recycling normally liquid reformate to the heat exchanger, the deposit of coronene in the heat exchanger can be removed.

SUMMARY OF THE INVENTION

In accordance with the invention there is provided a method of removing a coronene deposit in a reforming process which comprises the steps of:

(a) contacting a hydrocarbonaceous feedstock with a catalyst in the presence of added hydrogen at reforming conditions in a reforming zone;

(b) passing the resulting total reforming zone effluent into a heat exchange zone, said reforming zone effluent comprising coronene, at least a portion of which deposits in said heat exchange zone;

(c) separating the heat exchanged total reforming zone effluent into a hydrogen-rich gaseous phase and a liquid hydrocarbon phase comprising normally liquid hydrocarbons and normally gaseous hydrocarbons, the improvement which comprises recycling at least a portion of said normally liquid hydrocarbons to said heat exchange zone for a time sufficient to remove at least a portion of said coronene deposit from said heat exchange zone.

DESCRIPTION OF THE PREFERRED EMBODIMENT

Figure 1:
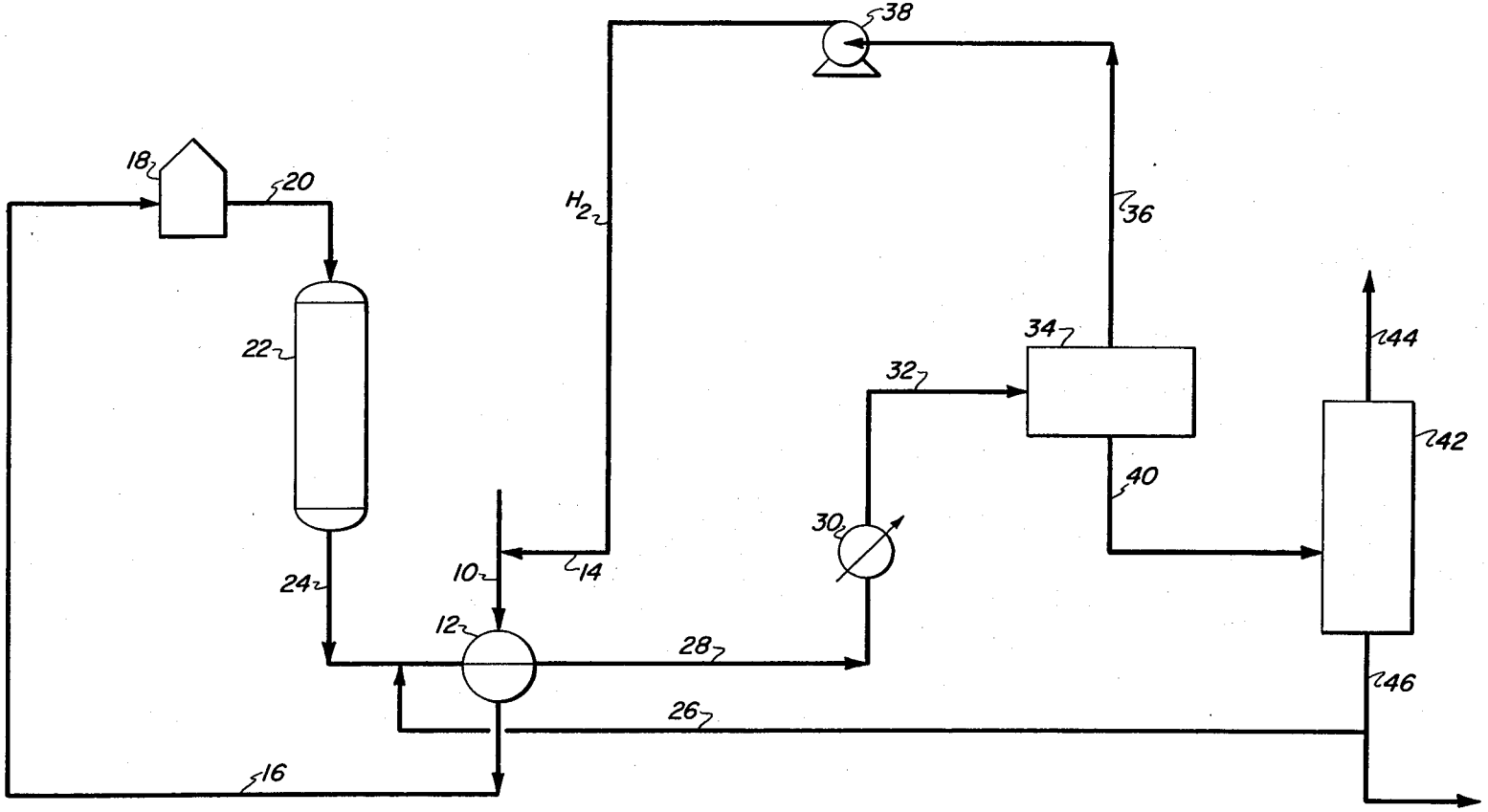
FIG. 1 is a schematic flow plan of one embodiment of the invention.

The preferred embodiment will be described with reference to the accompanying drawings. Referring to the FIG. 1, a conventional reformer feed is passed by line 10 into the shell of exchanger 12. Although only one heat exchanger is shown in the drawing, the heat exchanging may occur in a series of heat exchanging zones, as is well known in the art. A hydrogen-rich recycle gas is introduced into line 10 via line 14. Suitable reforming feeds include naphtha having an atmospheric pressure boiling point ranging from about 80 to about 450° F., preferably from about 150° to about 375° F. Generally, the feed is substantially sulfur-free, that is, the feed comprises less than about 25 wppm, preferably less than 10 wppm sulfur. In the shell of heat exchanger 12, the naphtha feed and hydrogen-rich gas are partially pre-heated and passed via line 16 to furnace 18 in which the mixture of naphtha feed and hydrogen-rich gas is additionally heated to reforming reaction temperature. The heated stream is passed via line 20 into reforming reactor 22 in which is disposed a bed of reforming catalyst. The reforming catalyst may be any of the known reforming catalysts. Suitable reforming catalysts include metals such as platinum or palladium, oxides and sulfides and certain metals such as molybdenum, chromium, vanadium and tungsten. The catalyst may be a multimetallic catalyst, such as catalysts comprising platinum, rhenium, or iridium composited with a suitable support such as alumina. The catalyst may comprise a halogen component such as chlorine. Conventional reforming conditions include a temperature range of from about 750° to 1050° F., a pressure ranging from about 50 to about 600 psig, a space velocity (volume of liquid feed per volume of catalyst per hour) of from 0.5 to 10. The reformer reaction is conducted in the presence of added hydrogen or added hydrogen-rich gas. The hydrogen concentration can vary from about 1000 to about 10,000 standard cubic feet per barrel of reformer feed. During the reforming process, naphthenes are dehydrogenated to the corresponding aromatics, paraffins are isomerized and aromatized, olefins are hydrogenated and some hydrocracking of high boiling constituents occurs. The reforming reaction also produces hydrogen. Undesired polycyclic aromatics, such as coronene, are produced during the reforming reaction. The coronene content of the effluent may vary from about 0.1 to about 20 wppm. When the content of coronene in the reformer effluent is relatively high, that is, at least 0.5 wppm, coronene may precipitate from the effluent to the surfaces of the heat exchanger. In accordance with the present invention, a portion of the normally liquid reformate is recycled to the heat exchange zone. The portion of reformate may be recycled directly into the heat exchange zone, for example, either a stream from line 40 or a stream from line 46 into heat exchanger 12 or stream of the liquid reformate may be recycled via line 26 into the effluent of the reformer which is subsequently introduced into the heat exchange zone. Suitably the reformate is recycled at a recycle ratio of recycle reformate to total reformer effluent ranging from about 0.1:1 to 1:1, preferably from about 0.3:1 to 0.5:1. The effluent of heat exchanger 12 is passed via line 28 to cooler 30 and then via line 32 to a separation zone 34 where the effluent is separated by conventional means into a gaseous phase and a liquid phase. The gaseous phase rich in hydrogen is removed from separation zone 34 via line 36, passed through compressor 38 and recycled via line 14 into naphtha feed line 10. The liquid hydrocarbon phase comprising the aromatics, light paraffins, olefinic hydrocarbons and butanes is withdrawn from separator 34, passed by line 40 into separation zone 42 wherein light paraffins, olefinic hydrocarbons and at least a portion of the butanes are removed via line 44. The remaining liquid reformate product (stabilized reformate) is removed by line 46. If desired, the temperature in the fouled exchanger may be lowered to a level sufficient to produce additional condensation of the reformate so as to dissolve an additional amount of coronene in the condensed reformate. The coronene removal procedure of the present invention can be conducted intermittently during reforming process operation.

Figure 2:
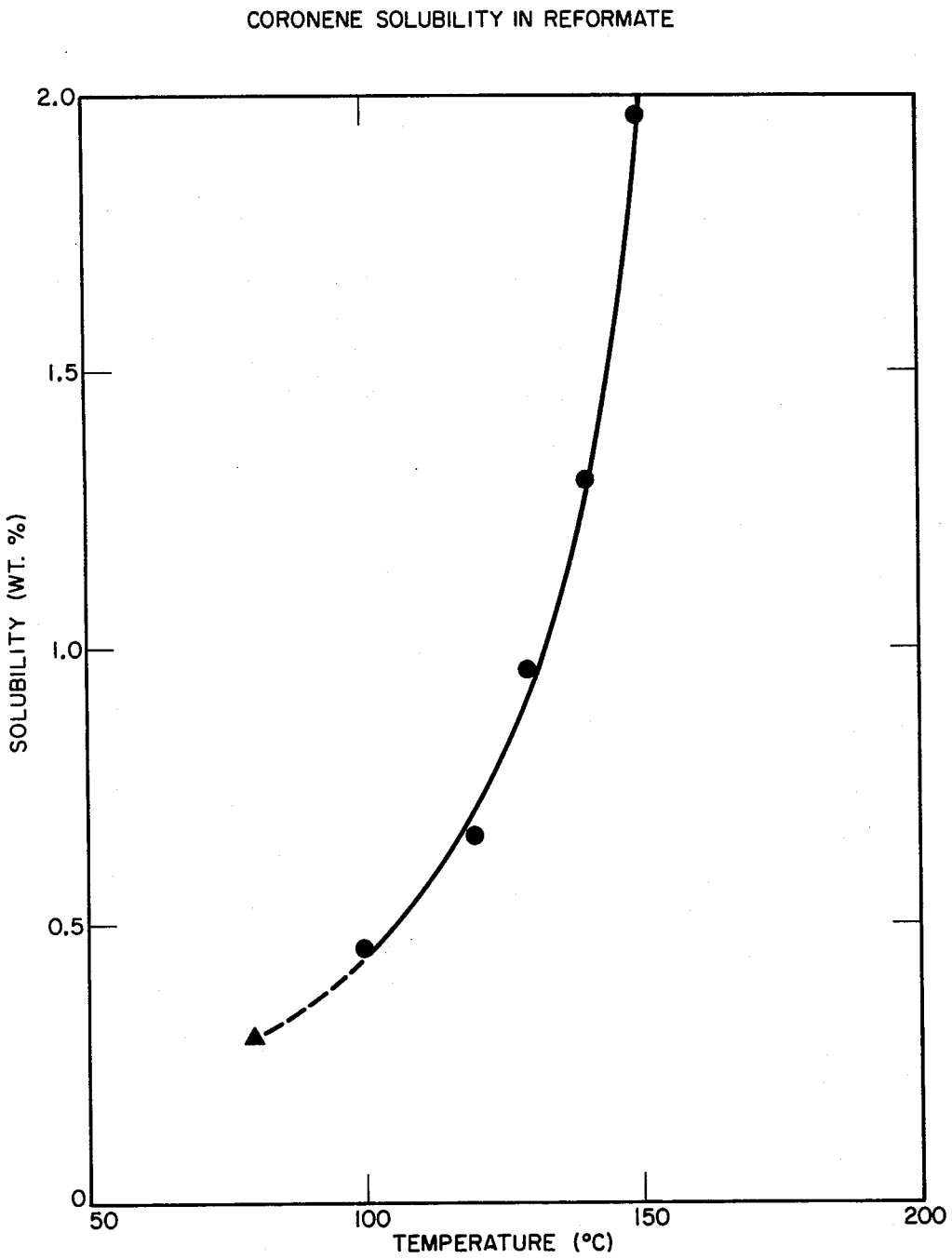
FIG. 2 is a plot showing coronene solubility in reformate relative to temperature.

FIG. 2 shows the solubility of coronene in reformate at various temperatures. Hence, the amount of coronene that can be removed at a given temperature with the recycled reformate of the present invention can readily be calculated.

What is claimed is:

1. A method for removing a coronene deposit in a reforming process, while said process is in operation, which comprises the steps of:

(a) contacting a hydrocarbonaceous feedstock having an atmospheric pressure boiling point ranging from about 150° to about 375° F. with a catalyst in the presence of added hydrogen at reforming conditions in a reforming zone;

(b) passing the resulting total reforming zone effluent into a heat exchange zone, said reforming zone effluent comprising at least about 0.5 wppm coronene, at least a portion of which deposits in said heat exchange zone;

(c) separating the heat exchanged total reforming zone effluent into a hydrogen-rich gaseous phase and a liquid hydrocarbon phase comprising normally liquid hydrocarbons and normally gaseous hydrocarbons, the improvement which comprises recycling a portion of said normally liquid hydrocarbons to said heat exchange zone for a time sufficient to remove at least a portion of said coronene deposit from said heat exchange zone.

2. The method of claim 1 wherein said liquid reformate is recycled to said heat exchange zone for a time sufficient to remove substantially all of said coronene deposit from said heat exchange zone.

3. The method of claim 1 wherein said liquid reformate is recycled to said heat exchange zone at a recycle ratio of recycle reformate to total reformer effluent ranging from about 0.1:1 to 1:1.

4. The method of claim 1 wherein said coronene removal is conducted intermittently in said reforming process.

* * * * *